US005125795A

United States Patent [19]

Suzuki et al.

[11] Patent Number: 5,125,795

[45] Date of Patent: Jun. 30, 1992

[54] WATER PUMP

[75] Inventors: Shigeru Suzuki; Satoru Ikeda; Takayuki Usui; Yutaka Yamada; Isamu Suzuki, all of Obu, Japan

[73] Assignee: Aisan Kogyo Kabushiki Kaisha, Aichi, Japan

[21] Appl. No.: 597,156

[22] Filed: Oct. 15, 1990

[30] Foreign Application Priority Data

Oct. 30, 1989 [JP] Japan ..... 1-126886[U]
Apr. 26, 1990 [JP] Japan ..... 2-44791[U]

[51] Int. Cl.[5] ..... F01D 25/32

[52] U.S. Cl. ..... 415/168.2; 416/169 A; 417/362

[58] Field of Search ..... 415/168.1, 168.2, 169.1; 416/169 A; 417/362

[56] References Cited

U.S. PATENT DOCUMENTS 3,912,375 10/1975 Franklin, Sr. ..... 416/204 R
4,936,742 6/1990 Eguchi et al. ..... 415/111

FOREIGN PATENT DOCUMENTS 2846778 6/1979 Fed. Rep. of Germany ... 416/169 A
54-129003 9/1979 Japan .
57-30400 2/1982 Japan .
61-103596 7/1986 Japan .
62-150596 9/1987 Japan .
63-146195 9/1988 Japan .

*Primary Examiner*—John T. Kwon
*Attorney, Agent, or Firm*—Oliff & Berridge

[57] ABSTRACT

A water pump including a pump housing having a central axial through-hole; a pump shaft inserted in the through-hole; a pulley fixed on the pump shaft at one end thereof; an impeller fixed on the pump shaft at the other end thereof; a bearing fitted with the through-hole for rotatably supporting the pump shaft in the vicinity of the pulley; a water seal provided between the impeller and the bearing for sealing water in a pump chamber where the impeller is installed, wherein an intermediate chamber is defined among the pump housing, the bearing and the water seal. A first ventilation passage is formed in a wall of the pump housing so as to induce an atomspheric air into the intermediate chamber. A second ventilation passage is formed in the wall of the pump housing so as to discharge a water vapor in the intermediate chamber to an outside of the pump housing. A vacuum generating portion is formed by rotation of the pulley in the vicinity of an outlet of the second ventilation passage opening to a space defined between the pulley and the pump housing, whereby when the pulley is rotated, the water vapor in the intermediate chamber is positively ventilated through the second ventilation passage by vacuum to be generated in the vacuum generating portion.

21 Claims, 17 Drawing Sheets

WATER PUMP

BACKGROUND OF THE INVENTION

The present invention relates to an improvement in a mechanical water pump of a type such that an impeller is rotated by a torque transmitted through a pulley and a pump shaft.

Such a water pump is suitably adapted to an engine to circulate an engine cooling water between the engine and a radiator by utilizing a torque of the engine.

In this type water pump, the pulley is fixed to one end of the pump shaft inserted in a pump housing, and the impeller is fixed to the other end of the pump shaft. Further, a water seal is provided on an intermediate portion of the pump shaft at a position adjacent to the impeller, so as to seal the cooling water from a pump chamber where the impeller is installed. Further, a bearing for rotatably supporting the pump shaft is provided between the pulley and the water seal in the pump housing.

In this type water pump, leakage of the water, particularly, a vapor of the water from the water seal cannot be completely avoided. As a result, the water vapor leaked from the water seal is dewed in an intermediate chamber defined by the pump housing, the bearing and the water seal, and the water dewed enters the bearing to cause deterioration of a grease or generation of rust, resulting in failure of the water pump.

To cope with this problem, there have been various structures in the prior art. For example, Japanese Utility Model Laid-open Publication No. 54-129003 discloses that the intermediate chamber defined by the pump housing, the bearing and the water seal is communicated through a ventilation hole to the outside of the pump housing. However, in this structure, the water vapor in the intermediate chamber cannot be positively ventilated, and the problem due to the water vapor cannot be accordingly avoided.

Japanese Utility Model Laid-open Publication Nos. 62-150596 and 63-146195 disclose that a partition disk is provided between the water seal and the bearing to prevent the water from reaching the bearing. However, in this structure, it is not possible to completely prevent the water from reaching the bearing. Accordingly, it is hard to avoid the deterioration of the grease or the like in the bearing for a long time.

Japanese Utility Model Laid-open Publication Nos. 63-146195, 56-76197, 61-103596 and 57-30400 disclose that a rotating fan is fixed to the pump shaft in the intermediate chamber between the water seal and the bearing to positively ventilate the water vapor in the intermediate chamber to the outside of the pump housing. However, in this structure, as the intermediate chamber is limited, an outer diameter of the rotating fan is obliged to be small. Accordingly, a ventilation efficiency is low.

Further, there is another problem such that a foreign matter such as mud or dust will enter the intermediate chamber from the ventilation hole to cause failure of the water seal or the bearing. To cope with this problem, Japanese Utility Model Laid-open Publication No. 63-150594 discloses that the ventilation hole opens to face a rear surface of the pulley seat, so as to prevent the foreign matter from directly entering the ventilation hole during running of a vehicle. However, in this structure, the ventilation of the water vapor in the intermediate chamber is not effected by the rotation of the pulley.

In consideration of the foregoing, Japanese Utility Model Laid-open Publication No. 63-146195 discloses that a ventilation hole communicated with the intermediate chamber opens to face the rear surface of the pulley seat and that a rotating fan having a large outer diameter is provided in the vicinity of the rear surface of the pulley seat so as to rotate with the pulley seat, so that an outside air can be positively fed from the ventilation hole into the intermediate chamber by utilizing the rotation of the pulley. According to this structure, the of the water vapor in the intermediate chamber can be effectively carried out by utilizing the rotating fan having a large outer diameter. However, the outer opening of the ventilation hole must be positioned to face the rear surface of the pulley seat. Accordingly, a degree of freedom of design of the water pump is limited. Furthermore, it has been found from a test result that the above structure of feeding the outside air into the intermediate chamber by utilizing the rotation of the pulley is lower in ventilation efficiency than a structure of sucking the intermediate chamber to the outside of the pump housing. Moreover, the conventional structures have a defect that the ventilation efficiency after stoppage of the rotation of the pulley is low.

SUMMARY OF THE INVENTION

It is a first object of the present invention to provide a water pump which can effectively ventilate a water vapor in the intermediate chamber.

It is a second object of the present invention to provide a water pump which can be designed without limitation of the position of the air inlet.

It is a third object of the present invention to provide a water pump which can improve a ventilation efficiency upon stoppage of the pulley.

According to the present invention, there is provided in a water pump including a pump housing having a central axial through-hole; a pump shaft inserted in said through-hole; a pulley fixed on said pump shaft at one end thereof; an impeller fixed on said pump shaft at the other end thereof; a bearing fitted with said through-hole for rotatably supporting said pump shaft in the vicinity of said pulley; a water seal provided between said impeller and said bearing for sealing water in a pump chamber where said impeller is installed, wherein an intermediate chamber is defined among said pump housing, said bearing and said water seal; the improvement comprising a first ventilation passage formed in a wall of said pump housing so as to induce an atmospheric air into said intermediate chamber; a second ventilation passage formed in said wall of said pump housing so as to discharge a water vapor in said intermediate chamber to an outside of said pump housing; and a vacuum generating portion to be formed by rotation of said pulley in the vicinity of an outlet of said second ventilation passage opening to a space defined between said pulley and said pump housing, whereby when said pulley is rotated, the water vapor in said intermediate chamber is positively ventilated through said second ventilation passage by vacuum to be generated in said vacuum generating portion.

With this construction, the water vapor in the intermediate chamber can be positively ventilated through the second ventilation passage by the vacuum to be generated by the rotation of the pulley. Accordingly, the problem due to the water vapor leaked from the water seal can be effectively avoided. Furthermore, the first ventilation passage can be formed at a desired position in the pump housing so as to prevent entry of a foreign matter into the intermediate chamber or quickly expel the water vapor in the intermediate chamber upon stoppage of the pulley.

The invention will be more fully understood from the following detailed description and appended claims when taken with the drawings.

DETAILED DESCRIPTION OF THE PREFERRED EMBODIMENTS

There will now be described some preferred embodiments of the present invention with reference to the drawings.

Figure 1:
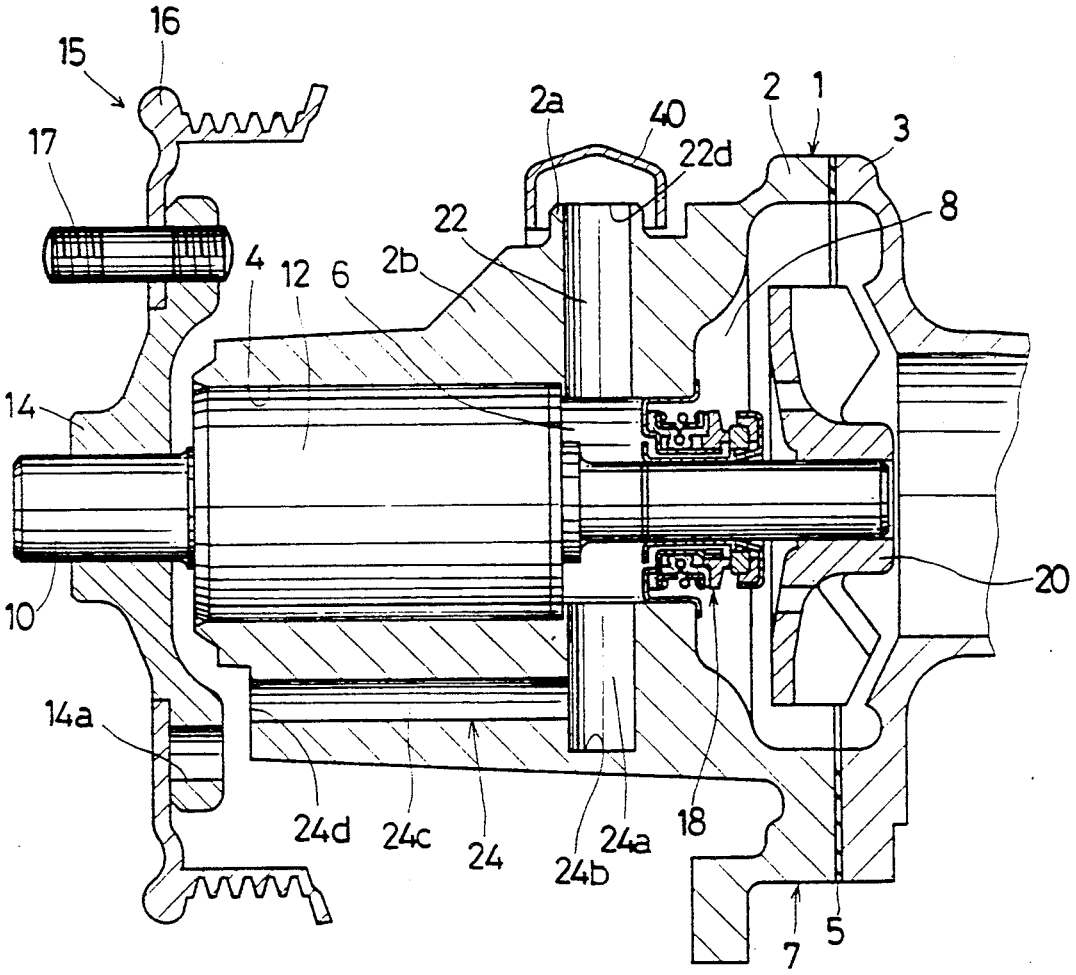
FIG. 1 is a vertical sectional view of a first preferred embodiment of the water pump according to the present invention.

Referring to FIG. 1 which shows a first preferred embodiment of the present invention, a water pump 1 has a pump housing 7 constructed of a pump body 2 and a pump cover 3 which are connected together through a sealing gasket 5. The pump body 2 is formed with a bearing chamber 4, an intermediate chamber 6 and a pump chamber 8 arranged in this order from the left side to the right side as viewed in FIG. 1.

A bearing 12 is press-fitted in the bearing chamber 4, and a pump shaft 10 is rotatably supported to the bearing 12.

The pump shaft 10 extends rightwardly from the bearing 12 through the intermediate chamber 6 to the pump chamber 8. An impeller 20 is mounted on the pump shaft 10 in the pump chamber 8 so as to be rotatable with the pump shaft 10. The pump shaft 10 also extends leftwardly from the bearing 12, and a pulley seat 14 is fixed on such an extended portion of the pump shaft 10. A pulley disk 16 is connected to the pulley seat 14 by means of a plurality of coupling bolts 17. The pulley seat 14, the pulley disk 16 and the coupling bolts 17 constitute a pulley 15. When an engine (not shown) is started to rotate the pulley 15 through a V-belt (not shown), the pump shaft 10 is rotated to thereby rotate the impeller 20 in the pump chamber 8.

A mechanical seal 18 is provided between the pump chamber 8 and the intermediate chamber 6 to seal a cooling water in the pump chamber 8.

Figure 2:
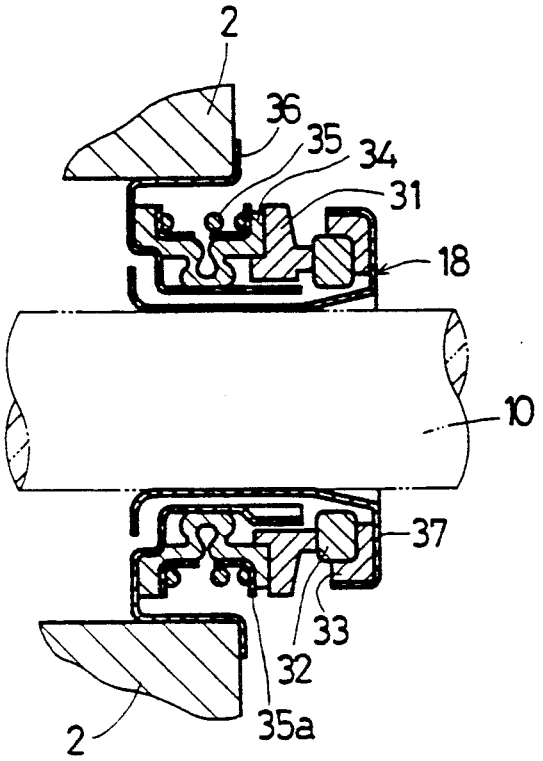
FIG. 2 is an enlarged view of a mechanical seal shown in FIG. 1.
Figure 3:
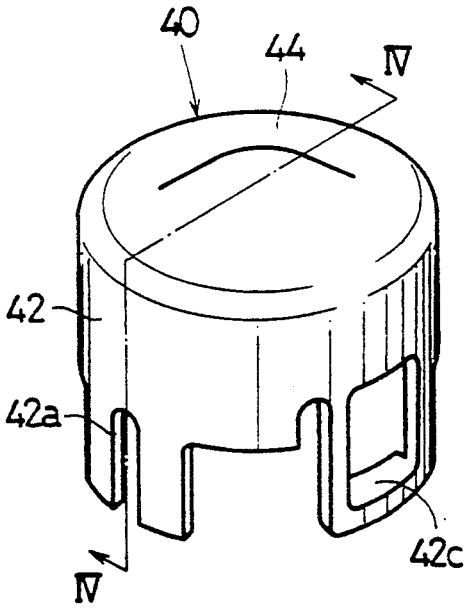
FIG. 3 is an enlarged perspective view of a cap shown in FIG. 1.
Figure 4:
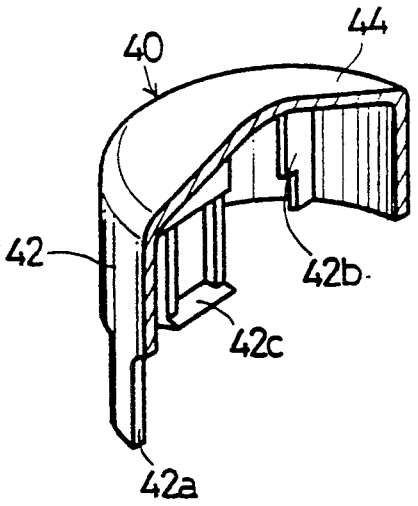
FIG. 4 is a cross section taken along the line IV—IV in FIG. 3.
Figure 5:
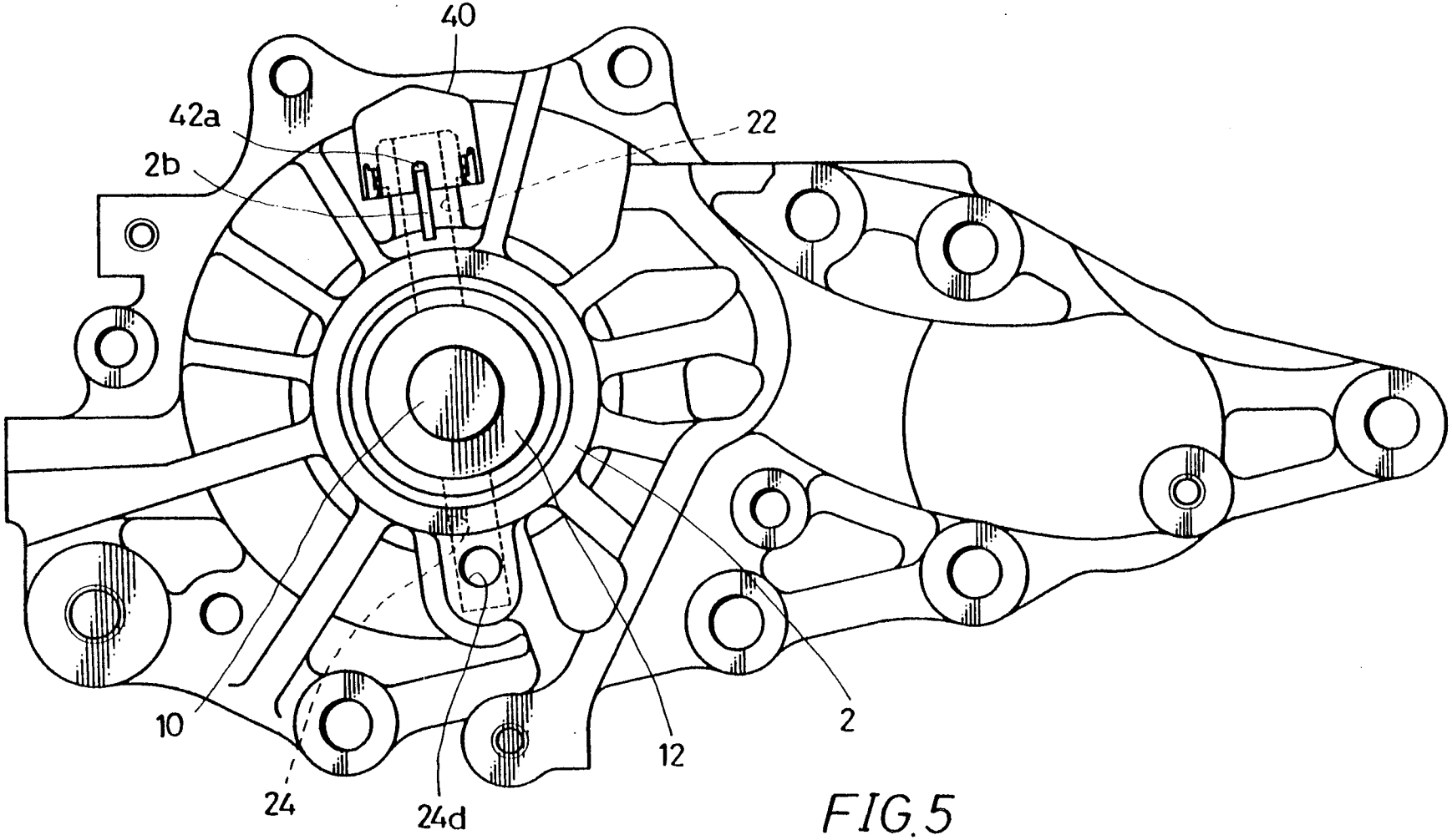
FIG. 5 is a left end view of FIG. 1.
Figure 6:
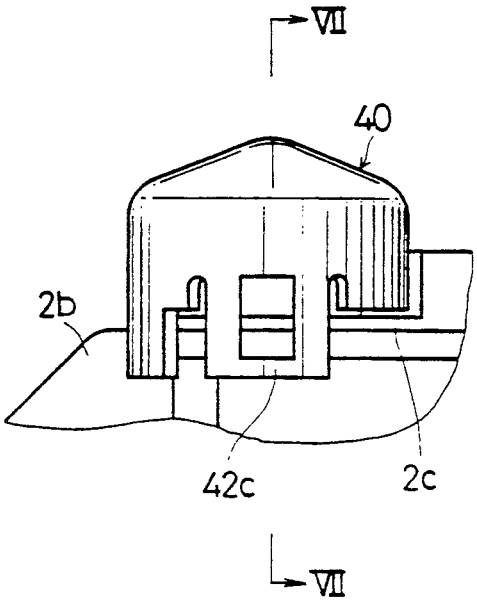
FIG. 6 is an enlarged side view of the cap mounted on a pump body shown in FIG. 1.
Figure 7:
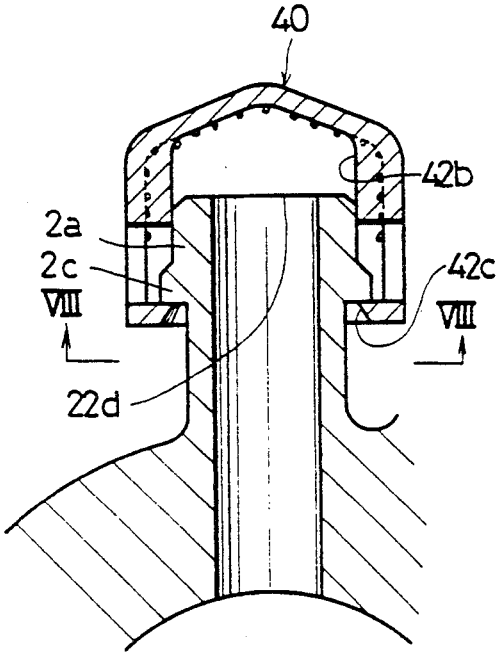
FIG. 7 is a cross section taken along the line VII—VII in FIG. 6.

As shown in FIG. 2, the mechanical seal 18 is constructed of a cartridge 36 press-fitted in the pump body 2, a seal ring 31 mounted in the cartridge 36, associated parts thereof, a sleeve 37 press-fitted with the pump shaft 10, a floating seat 32 mounted in the sleeve 37, and associated parts thereof. A sealing portion is formed between the seal ring 31 and the floating seat 32.

A spring 35, a spring holder **35*a* and a bellows rubber 34 are provided between the seal ring 31 and the cartridge 36. The seal ring 31 is biased against the floating seat 32 by a biasing force of the spring 35. A gasket rubber 33 is provided between the floating seat 32 and the sleeve 37 so as to eliminate sealing failure due to vibration. In general, the seal ring 31 is formed of carbon, and the floating seat 32** is formed of ceramics.

As the pump shaft 10 is rotated by the pulley 15, the floating seat 32 under rotation contacts the seal ring 31. Accordingly, there is generated heat at a sliding contact portion between the floating seat 32 and the seal ring 31. As a result, the water in the pump chamber 8 tends to be vaporized by the heat, and the water vapor generated enters the intermediate chamber 6. To eliminate the water vapor from the intermediate chamber 6 to the outside of the pump housing 7, the following construction is provided in this preferred embodiment.

That is, a first passage 22 and a second passage 24 are formed in the wall of the pump body 2 of the water pump 1. The first passage 22 extends straight vertically upwardly from a top portion of the intermediate chamber 6 through a projection **2*a* of the pump body 2 to the outside of the pump body 2. The first passage 22 has a diameter larger than that of a discharge passage 24c of the second passage 24** to be hereinafter described.

The second passage 24 is composed of a drain passage 24a extending straight vertically downward from a bottom portion of the intermediate chamber 6 and a discharge passage 24c extending horizontally or slightly downwardly inclined from a midway portion of the drain passage 24a to the outside of the pump body 2. A bottom portion of the drain passage 24a is formed as a recess 24b for storing a foreign matter such as a grease, so as to prevent blocking of the discharge passage 24c.

An opening 24d of the discharge passage 24c is opposed to a rear surface of the pulley seat 14 in the vicinity thereof. Accordingly, when the pulley 15 is rotated by the operation of the engine, the air present between pulley seat 14 and the pump body 2 is influenced by the torque of the pulley 15 to flow outwardly in the radial direction of the pulley seat 14, so that there is generated vacuum at the opening 24d of the discharge passage 24c. As a result the air in the second passage 24 is positively expelled by the vacuum, and accordingly the outside air is sucked from the opening 22d of the first passage 22. Thus, the air in the intermediate chamber 6 can be positively ventilated.

After the engine is stopped, the positive ventilation by the rotation of the pulley 15 is stopped. However, a temperature of the air in the intermediate chamber 6 is higher than that of the outside air, that is, a density of the air in the intermediate chamber 6 is smaller than that of the outside air, and a saturated vapor pressure in the intermediate chamber 6 is higher than that of the outside air. As a result, the air and the water vapor in the intermediate chamber 6 tends to move upwardly from the intermediate chamber 6 to the outside. As the first passage 22 extends upwardly vertically from the top portion of the intermediate chamber 6, the air and the water vapor in the intermediate chamber 6 can be smoothly expelled from the opening 22d of the first passage 22, thus effecting natural ventilation. Furthermore, as the diameter of the first passage 22 is larger than that of the discharge passage 24c, the natural ventilation can be accelerated.

A cap 40 is mounted on the projection 2a of the pump body 2 to cover the opening 22d so as to allow air flow between the first passage 22 and the outside, so that a foreign matter may not enter the first passage 22.

Figure 8:
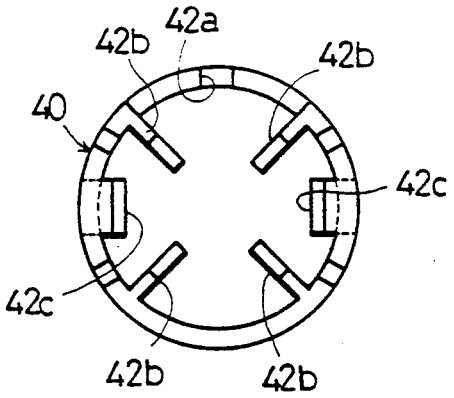
FIG. 8 is a bottom plan view of the cap.

Referring to FIGS. 3 to 8 which show a preferred embodiment of the cap 40 and a mounting structure thereof, the cap 40 is composed of a barrel portion 42 and a conical head portion 44 integrally formed with the barrel portion 42. The barrel portion 42 is formed at its lower end with a recess 42a to be engaged with a body rib 2b of the pump body 2, so as to prevent rotation of the cap 40. Further, a plurality of inner ribs 42b each having a shoulder are formed on the inner wall surface of the barrel portion 42 to extend vertically. As shown in FIG. 8, the inner ribs 42b are arranged at circumferentially equal intervals. The inner ribs 42b are to be uniformly fitted with the cylindrical projection 2a of the pump body 2. Accordingly, the inner wall surfaces of the barrel portion 42 and the head portion 44 do not directly contact the projection 2a but an air flow gap is defined between the cap 40 and the projection 2a. Further, a pair of snap fits 42c are formed at the lower end of the barrel portion 42 at diametrically opposite positions. The snap fits 42c are to be resiliently engaged with a pair of stoppers 2c formed on the outer surface of the projection 2a, thereby preventing disengagement of the cap 40 from the projection 2a of the pump body 2.

The cap 40 is formed of resin having a heat conductivity smaller than that of metal. On the other hand, the pump body 2 is formed of aluminum alloy. Accordingly, heat of the pump body 2 is hard to be transferred to the cap 40, so that temperature of the cap 40 is maintained near an atmospheric air temperature sufficiently lower than the temperature of the pump body 2.

As mentioned above, after stoppage of the engine, the water vapor in the intermediate chamber 6 is discharged from the opening 22d of the first passage 22 by natural ventilation, and is allowed to pass through the gap defined between the inner circumferential surface of the cap 40 and the projection 2a of the pump body 2. At this time, since the temperature of the cap 40 is sufficiently lower than that of the pump body 2, the water vapor discharged from the opening 22d of the first passage 22 comes into contact with the cap 40 and is partially cooled to generate dew drops on the inner surface of the cap 40. As the head portion 44 of the cap 40 is conical, the dew drops are allowed to flow on the inner surface of the cap 40 and fall down outside the pump body 2. As the result that the water vapor is dewed as mentioned above, a vapor pressure in the cap 40 is reduced to thereby accelerate the natural ventilation of the water vapor in the intermediate chamber 6.

Figure 9:
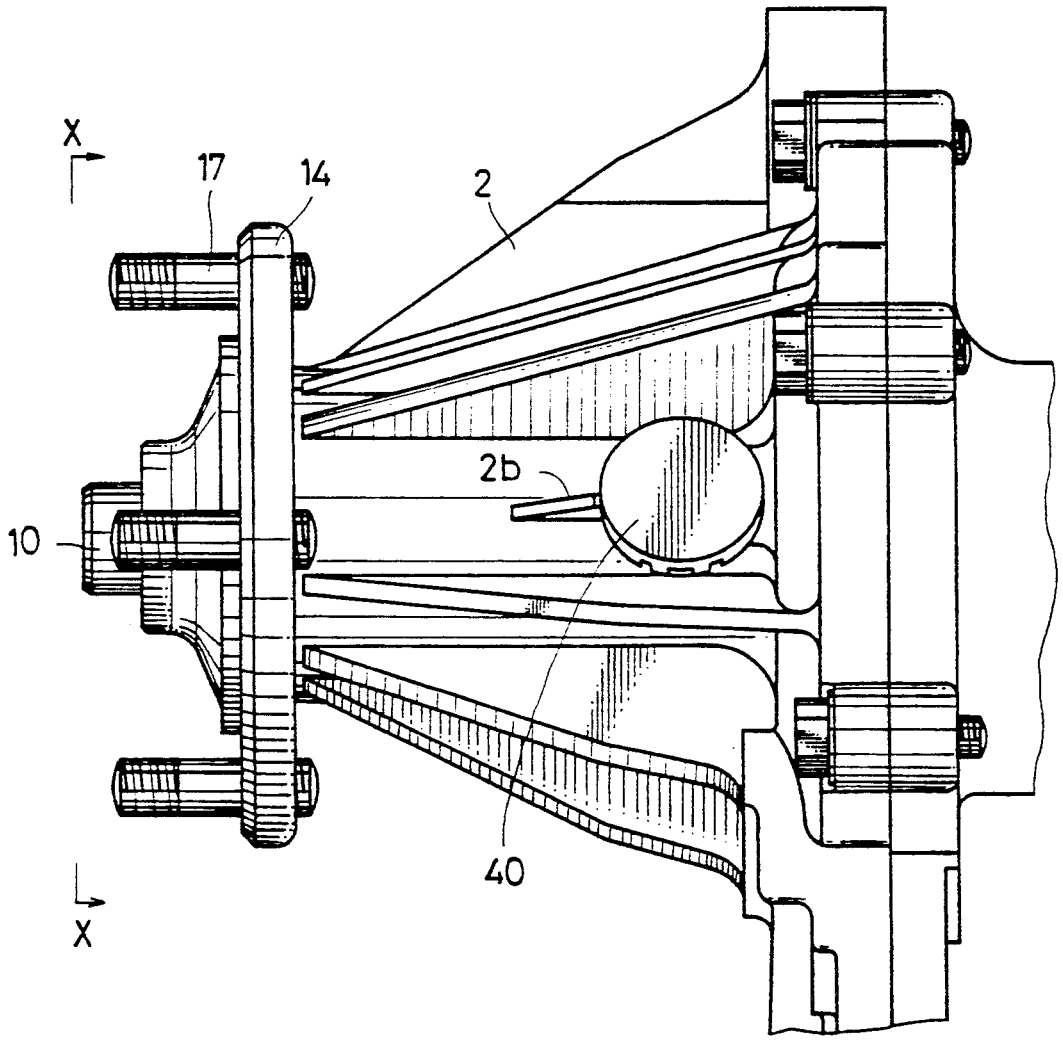
FIG. 9 is a top plan view of the water pump shown in FIG. 1.
Figure 10:
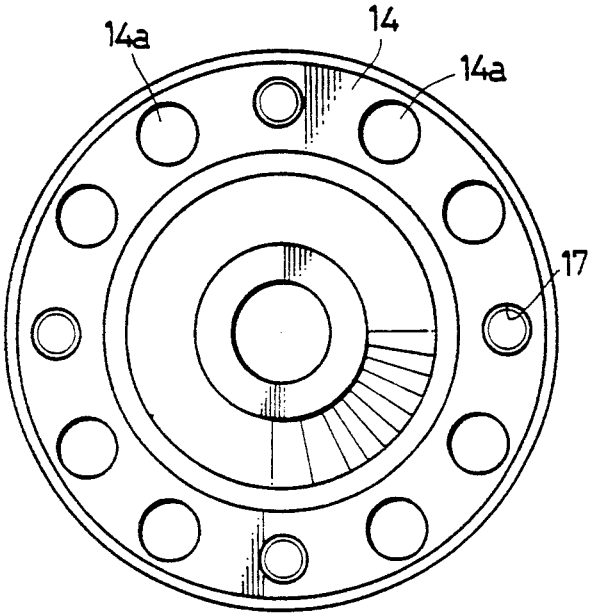
FIG. 10 is an elevational view of a pulley seat taken along the line X—X in FIG. 9.

Referring to FIGS. 9 and 10 which show the construction of the pulley seat 14 in this preferred embodiment, an annular portion of the pulley seat 14 is formed with a plurality of through-holes 14a arranged at circumferentially predetermined intervals except four coupling holes 17a for insertion of the coupling bolts 17, so that a weight of the pulley seat 14 can be reduced by the through-holes 14a to thereby reduce a load to be applied to the bearing 12. Further, as shown in FIG. 1, each through-hole 14a is located at a position radially slightly outside the position of the opening 24d of the second passage 24, so that fan operation of the pulley seat 14 can be accelerated.

As mentioned above, while the engine is being driven, the rotation of the pulley 15 generates a vacuum in the space defined between the pulley seat 14 and the pump body 2. As a result, the ventilation of the air in the intermediate chamber 6 can be positively effected by suction owing to the vacuum generated at the opening 24d of the second passage 24. Thus, the ventilation efficiency can be improved in the second passage 24 where choking tends to occur. Further, as the opening 22d of the first passage 22 functioning as a suction passage in this case is covered with the cap 40, entry of a foreign matter can be prevented.

On the other hand when the engine is stopped, the positive ventilation by the rotation of the pulley 15 is stopped. However, the air and the water vapor in the intermediate chamber 6 are discharged from the opening 22d of the first passage 22 by the natural ventilation, and a part of the water vapor is dewed on the inner surface of the cap 40 to fall down outside the pump body 2. Accordingly, the natural ventilation can be accelerated.

According to the above construction, water is hard to stay in the intermediate chamber 6, thus suppressing the generation of corrosion and preventing flow of the grease out of the bearing 12 with the water.

Further, a foreign matter is hard to enter the pump body 2, thus suppressing wear of the sealing portion.

According these effects, a service life of the water pump can be extended.

Figure 11:
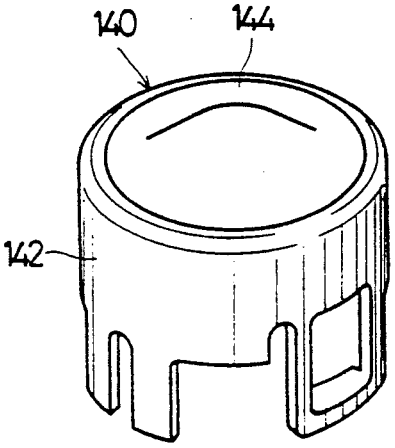
FIG. 11 is an enlarged perspective view of a modification of the cap.
Figure 12:
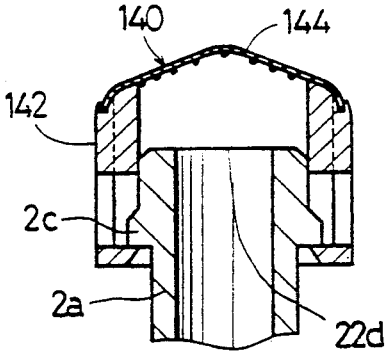
FIG. 12 is a vertical sectional view of the cap shown in FIG. 11 mounted to the pump body.

Referring to FIGS. 11 and 12 which show a modification of the cap 40 in the first preferred embodiment, a cap 140 in this modification is constructed of a head portion 144 formed of metal plate and a barrel portion 142 formed of resin. With this construction, the transmission of heat from the pump body 2 can be blocked by the resin barrel portion 142 to some extent. Further, as the head portion 144 is formed of metal having a heat conductivity higher than resin, the heat radiation from the head portion 144 can be improved.

Accordingly, a cooling efficiency of the water vapor discharged from the opening 22*d* of the first passage 22 under the engine stopping condition can be improved to further accelerate the dewing of the water vapor and more effectively carry out the natural ventilation.

Figure 13:
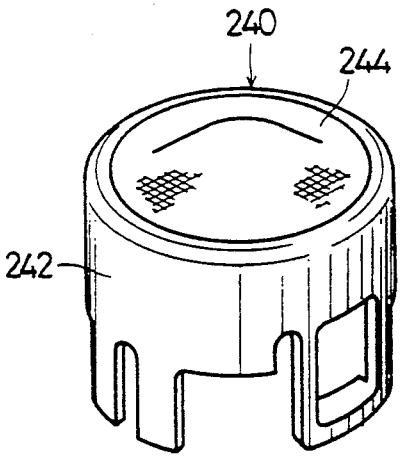
FIG. 13 is an enlarged perspective view of another modification of the cap.

Referring to FIG. 13 which shows another modification of the cap 40 in the first preferred embodiment, a cap 240 in this modification is constructed of a head portion 244 formed of metal or resin net and a barrel portion 242 formed of resin. With this construction, the water vapor can be discharged through the head portion 244 in addition to the improvement of the cooling efficiency. Even when water drops fall on the head portion 244 of the cap 240, a film of the water is formed on the net of the head portion 244 by a surface tension of the water, thereby inhibiting entry of the water drops into the pump body 2.

Figure 14:
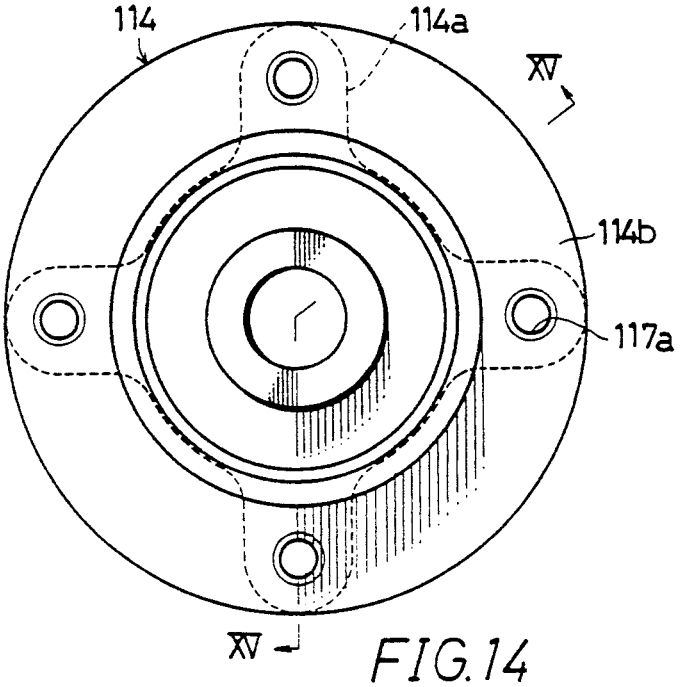
FIG. 14 is a view similar to FIG. 10, showing a modification of the pulley seat.
Figure 15:
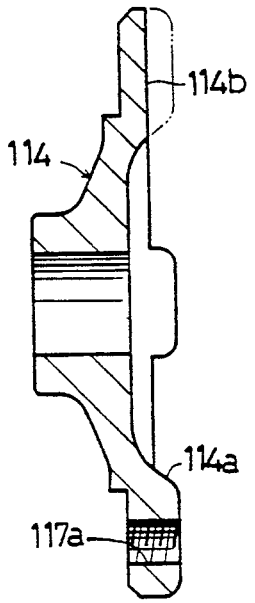
FIG. 15 is a cross section taken along the line XV—XV in FIG. 14.

Referring to FIGS. 14 and 15 which show a modification of the pulley seat 14 in the first preferred embodiment, an annular portion of a pulley seat 114 in this modification is formed with a plurality of thin-walled portions 114*b* except a portion where four coupling bolt insert holes 117*a* are formed. With this construction, a weight of the pulley seat 114 can be reduced to reduce a load to be applied to the bearing 12. Further, as the uneven annular portion of the pulley seat 114 crosses near the opening 24*d* of the second passage 24, a fan operation of the pulley seat 114 can be facilitated.

Figure 16:
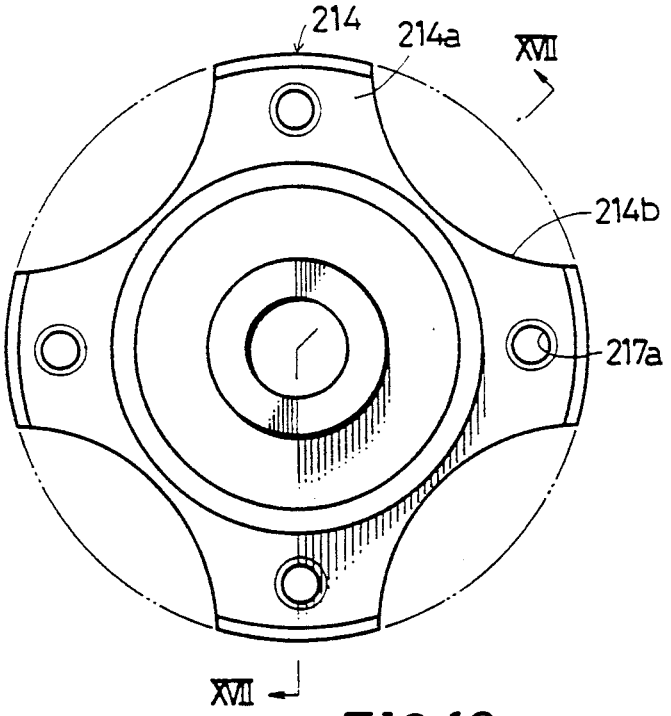
FIG. 16 is a view similar to FIG. 10, showing another modification of the pulley seat.
Figure 17:
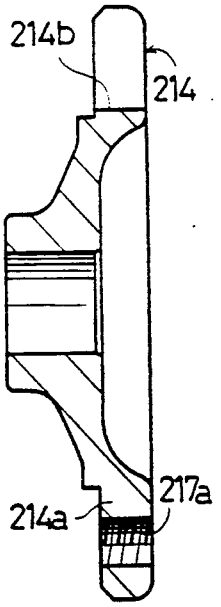
FIG. 17 is a cross section taken along the line XVII—XVII in FIG. 16.

Referring to FIGS. 16 and 17 which show another modification of the pulley seat 14 in the first preferred embodiment, an annular portion of a pulley seat 214 in this modification is formed with a plurality of cut-away portions 214*b* except a portion where four coupling bolt insert holes 217*a* are formed. With this construction, a weight of the pulley seat 214 can be further reduced to further reduce a load to be applied to the bearing 12. Further, a fan operation of the pulley seat 214 can be also facilitated.

Figure 18:
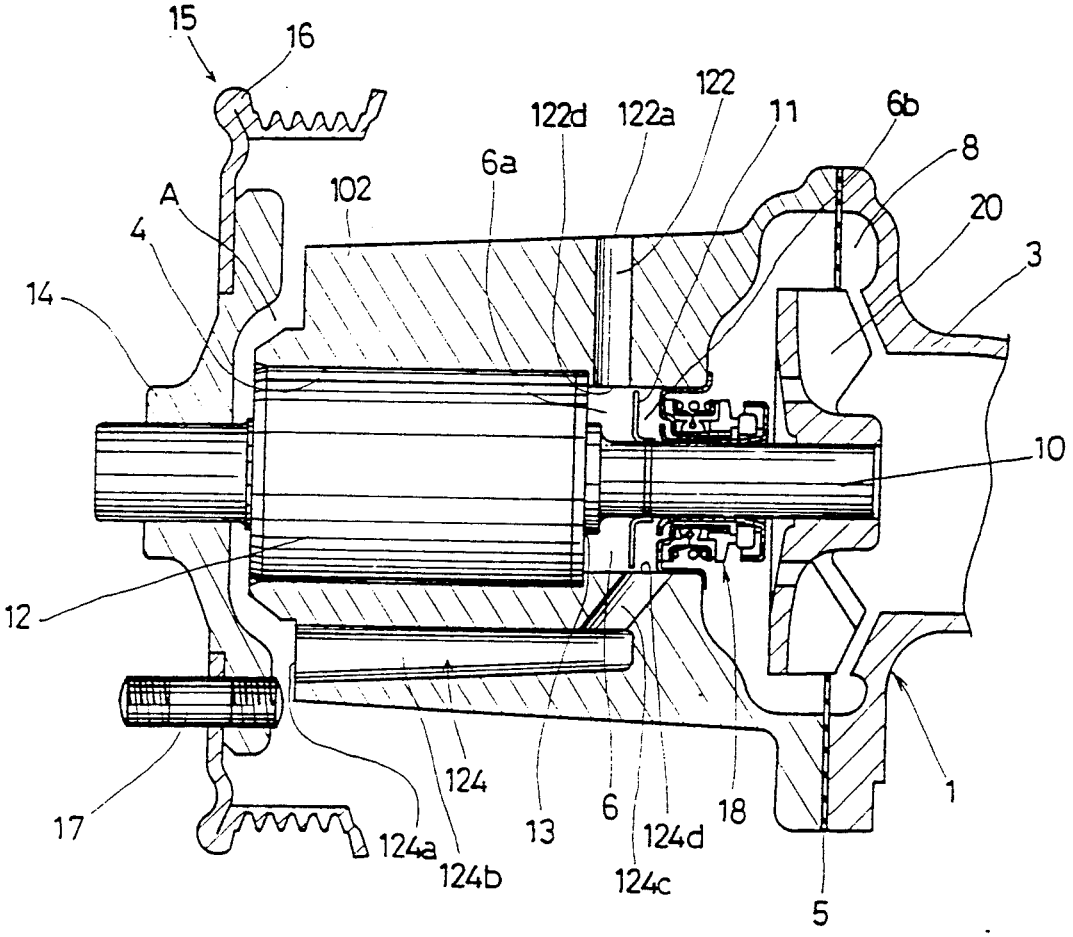
FIG. 18 is a view similar to FIG. 1, showing a second preferred embodiment of the present invention.

Referring to FIG. 18 which shows a second preferred embodiment of the present invention, a pump body 102 is formed substantially circularly so that an end portion of the pump body 102 opposed to the pulley seat 14 is enlarged in outer diameter as compared with the first preferred embodiment. Accordingly, the vacuum to be generated in a space A defined between the pump body 102 and the pulley seat 14 during rotation of the pulley 15 can be enlarged to thereby improve the positive ventilation. An opening 122*a* of a suction passage 122 is directly exposed to the atmospheric air without providing a cap as mentioned in the first preferred embodiment, and a diameter of the suction passage 122 is smaller than that of the first passage 22 of the first preferred embodiment. A discharge passage 124 is comprised of a main passage 124*b* opening into the space A and an inclined intermediate passage 124*c* opening into the intermediate chamber 6. The main passage 124*b* is downwardly inclined toward its opening 124*a*, so as to accelerate flowing of water or the like toward the opening 124*a* and suppress reverse flow of outside water or the like into the main passage 124*b*.

Figure 29:
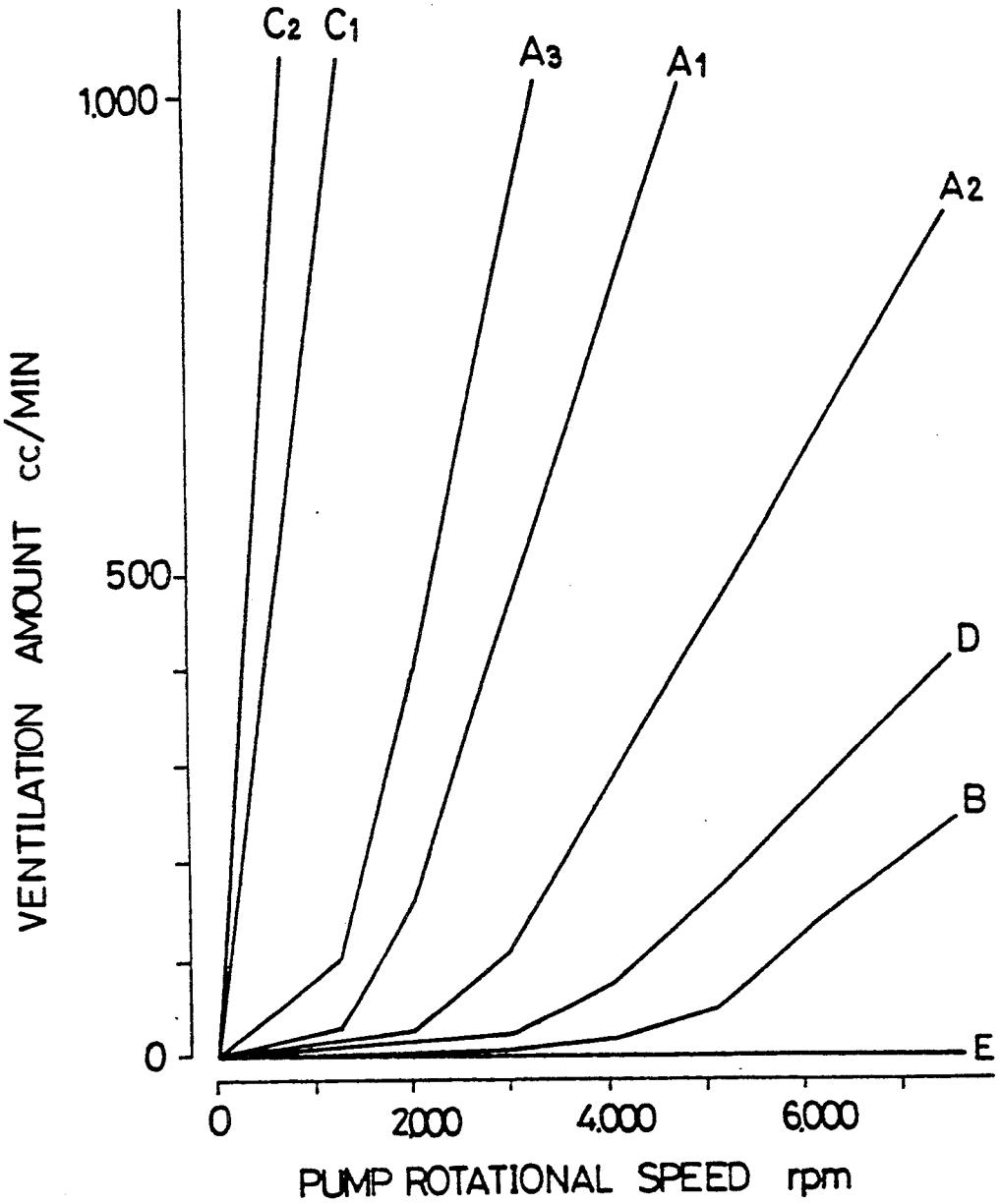
FIG. 29 is a graph showing various ventilation characteristics.

Further, a circular partition disk 11 is fixedly mounted on the pump shaft 10 in the intermediate chamber 6 to partition the intermediate chamber 6 into a first chamber 6*a* on the bearing 12 side and a second chamber 6*b* on the mechanical seal 18 side in such a manner that an annular gap for allowing flow of air is defined between the outer circumference of the partition disk 11 and the inner surface of the intermediate chamber 6. An inner opening 122*d* of the suction passage 122 is exposed to the first chamber 6*a*, while an inner opening of the intermediate passage 124*c* of the discharge passage 124 is exposed to the second chamber 6*b*. Accordingly, the air from the suction passage 122 is allowed to flow from the first chamber 6*a* through the annular gap to the second chamber 6*b*, so that the water vapor from the mechanical seal 18 is suppressed from reaching the bearing 12. A ventilation characteristic in this preferred embodiment is shown by a line A2 in FIG. 29. In comparison with this, a ventilation characteristic of the prior art device having a ventilation fan in the intermediate chamber is shown by a line D in FIG. 29. Further, a line E in FIG. 29 shows that no ventilation is generated.

The other construction is substantially the same as that in the first preferred embodiment shown in FIG. 1, and the same reference numerals designate the same parts.

Figure 19:
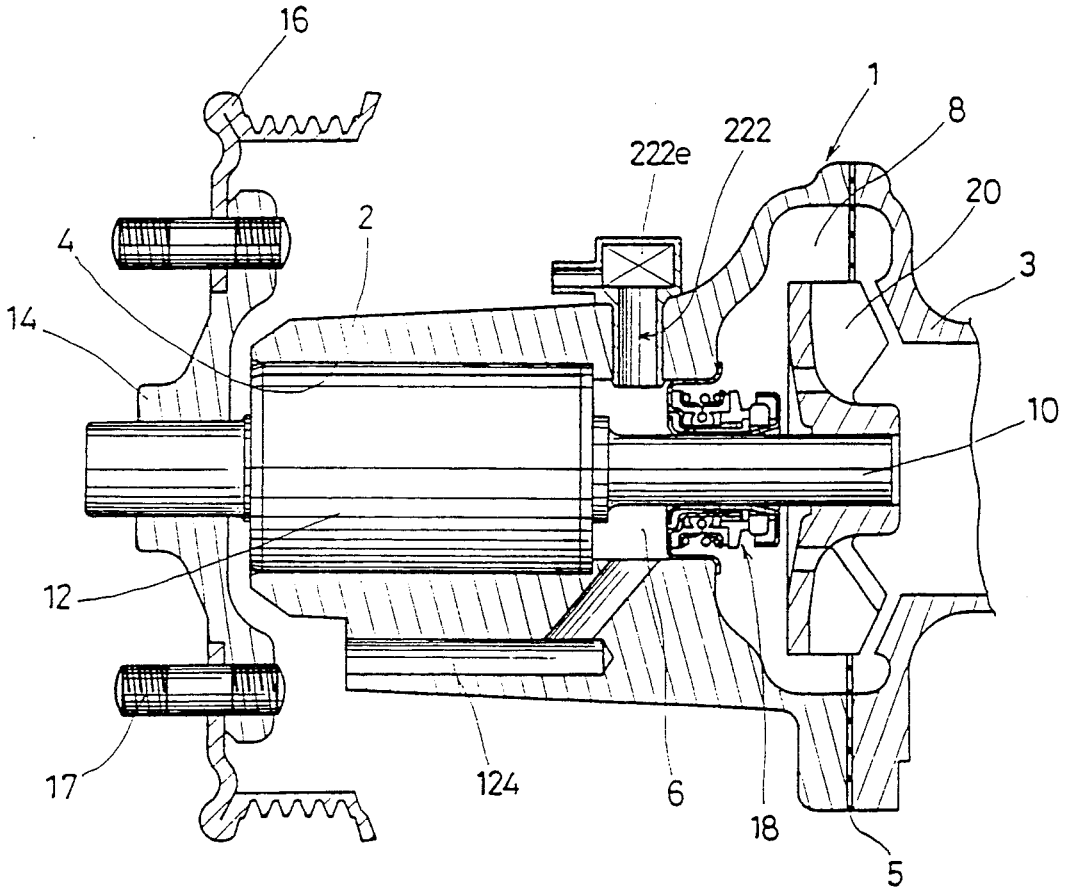
FIG. 19 is a view similar to FIG. 1, showing a third preferred embodiment of the present invention.

Referring to FIG. 19 which shows a third preferred embodiment of the present invention, an air filter 222*e* is provided in the midway of a suction passage 222, so as to filtrate the outside air to be sucked into the suction passage 222. Accordingly, dust is prevented from entering the seal portion of the mechanical seal 18, thereby extending a service life of the mechanical seal 18. A ventilation characteristic in this preferred embodiment is shown by a line B in FIG. 29. The other construction is substantially the same as that in the first preferred embodiment.

Figure 20:
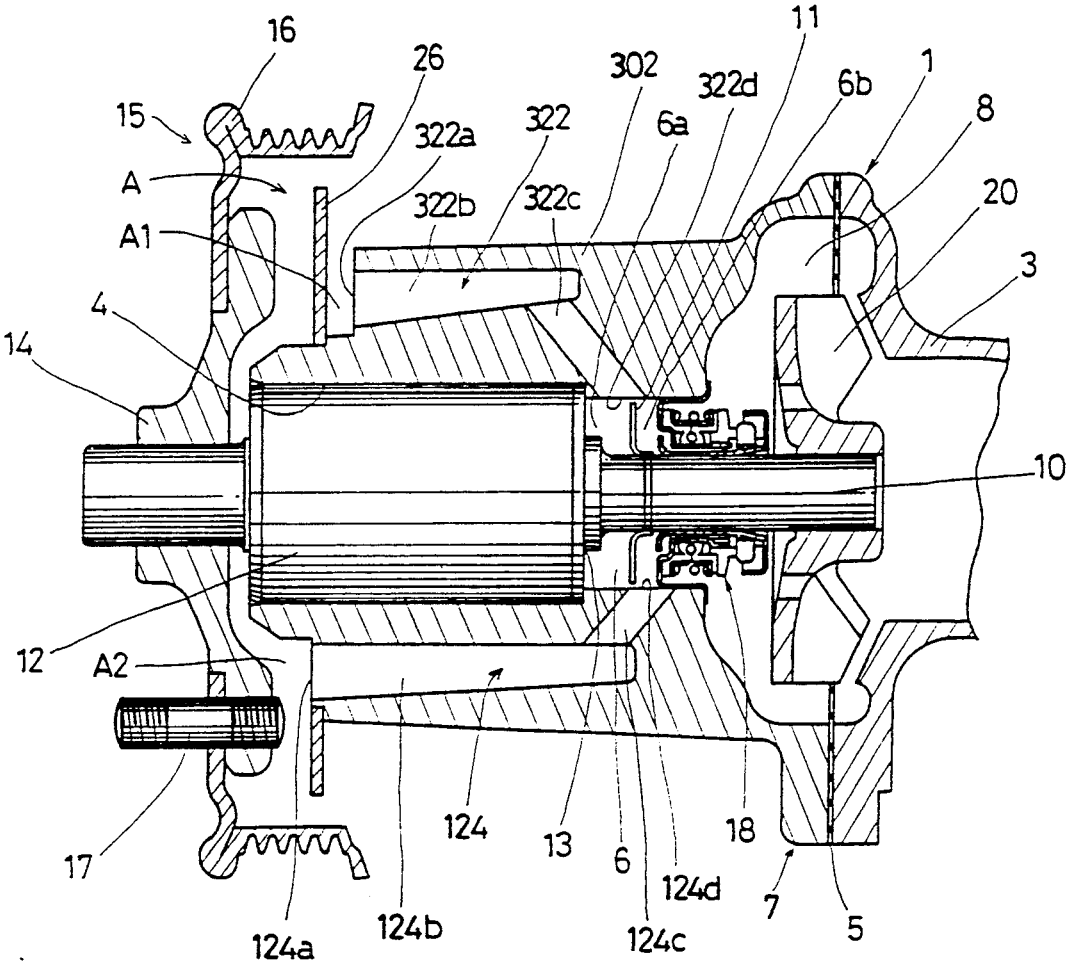
FIG. 20 is a view similar to FIG. 1, showing a fourth preferred embodiment of the present invention.

Referring to FIG. 20 which shows a fourth preferred embodiment of the present invention, a suction passage 322 formed in a pump body 302 is constructed of a main passage 322*b* opening to a rear side of the pulley seat 14 and an inclined intermediate passage 322*c* opening into the intermediate chamber 6. A circular partition disk 26 is fixedly mounted on the end portion of the pump body 302 so as to partition a space A defined between the pulley seat 14 and an outer opening 322*a* of the suction passage 322. Accordingly, vacuum to be generated in the space A is prevented from being applied to the outer opening 322*a* by the partition disk 26, with the result that a space A1 defined between the partition disk 26 and the outer opening 322*a* is maintained under the atmospheric pressure, while a space A2 defined between the pulley seat 14 and the outer opening 124*a* of the discharge passage 124 is maintained under vacuum. A ventilation characteristic of this preferred embodiment is shown by a line Al in FIG. 29. The other construction is substantially the same as that shown in FIG. 18.

Figure 21:
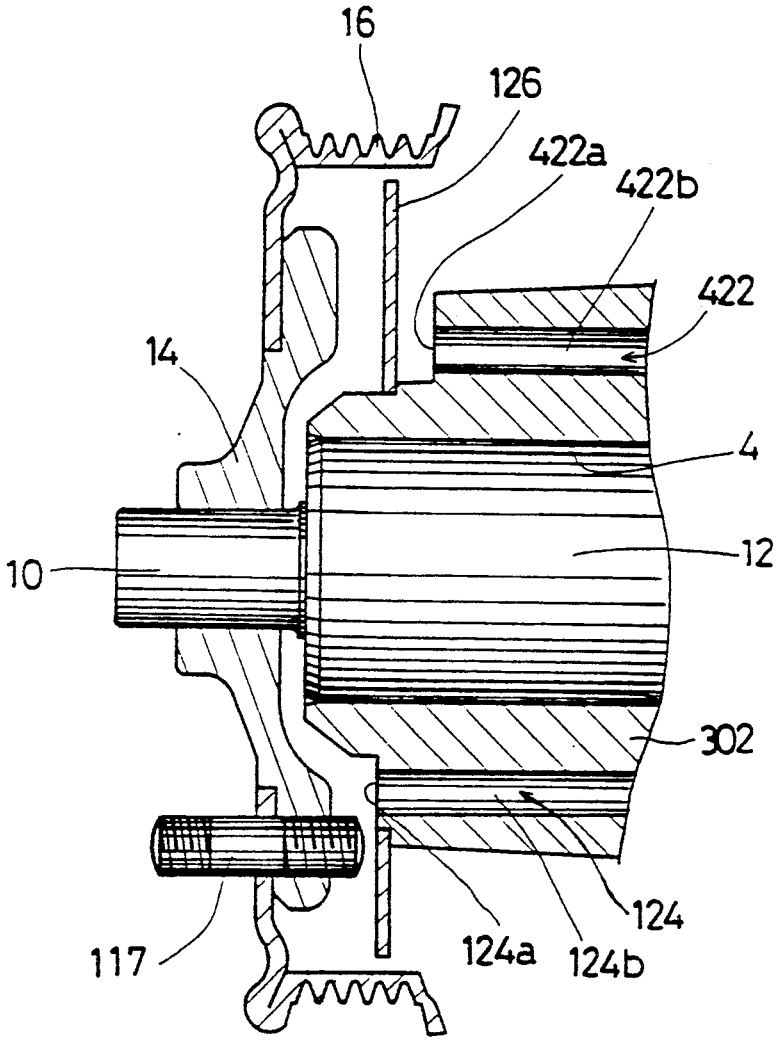
FIG. 21 is a vertical sectional view of an essential part showing a modification of the fourth preferred embodiment.

Referring to FIG. 21 which shows a modification of the fourth preferred embodiment shown in FIG. 20, a plurality of coupling bolts 117 project to the pump body 302, so that they function as the fin means according to the present invention. Further, an outer diameter of a partition disk 126 fixed to the pump body 302 is enlarged so as to reduce a gap between the outer circumference of the partition disk 126 and the inner circumference of the pulley disk 16, so that a partition effect of the partition disk 26 can be improved. According to this modification, the fan operation of the pulley seat 14 can be facilitated by the projecting portions of the coupling bolts 117 to thereby generate a large vacuum near the outer opening 124*a* of the discharge passage 124. A ventilation characteristic of this modification is shown by a line A3 in FIG. 29.

Figure 22:
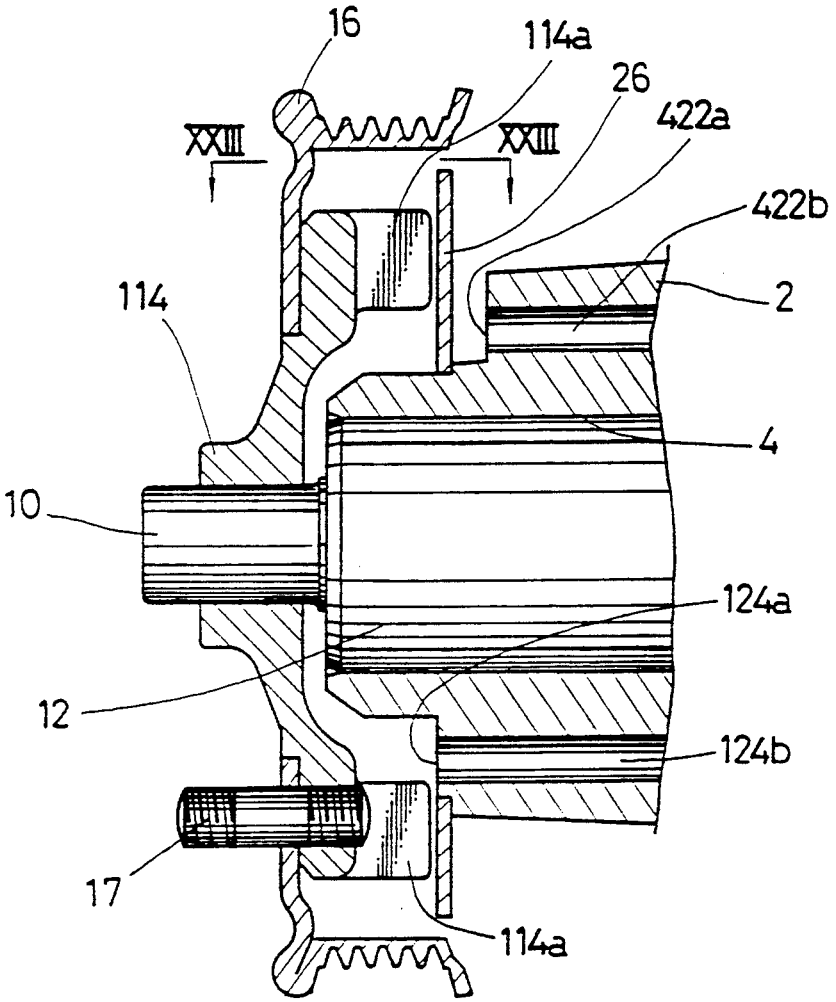
FIG. 22 is a view similar to FIG. 21, showing another modification of the fourth preferred embodiment.
Figure 23:
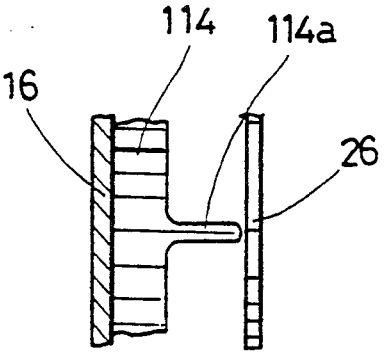
FIG. 23 is a cross section taken along the line XXIII—XXIII in FIG. 22.

Referring to FIGS. 22 and 23 which show another modification of the fourth preferred embodiment shown in FIG. 20, a pulley seat 114 is integrally formed with a plurality of fins 114*a* by forging, for example. With this construction, the fan operation of the pulley seat 114 can be more facilitated. A ventilation characteristic of this modification is shown by a line Cl in FIG. 29.

Figure 24:
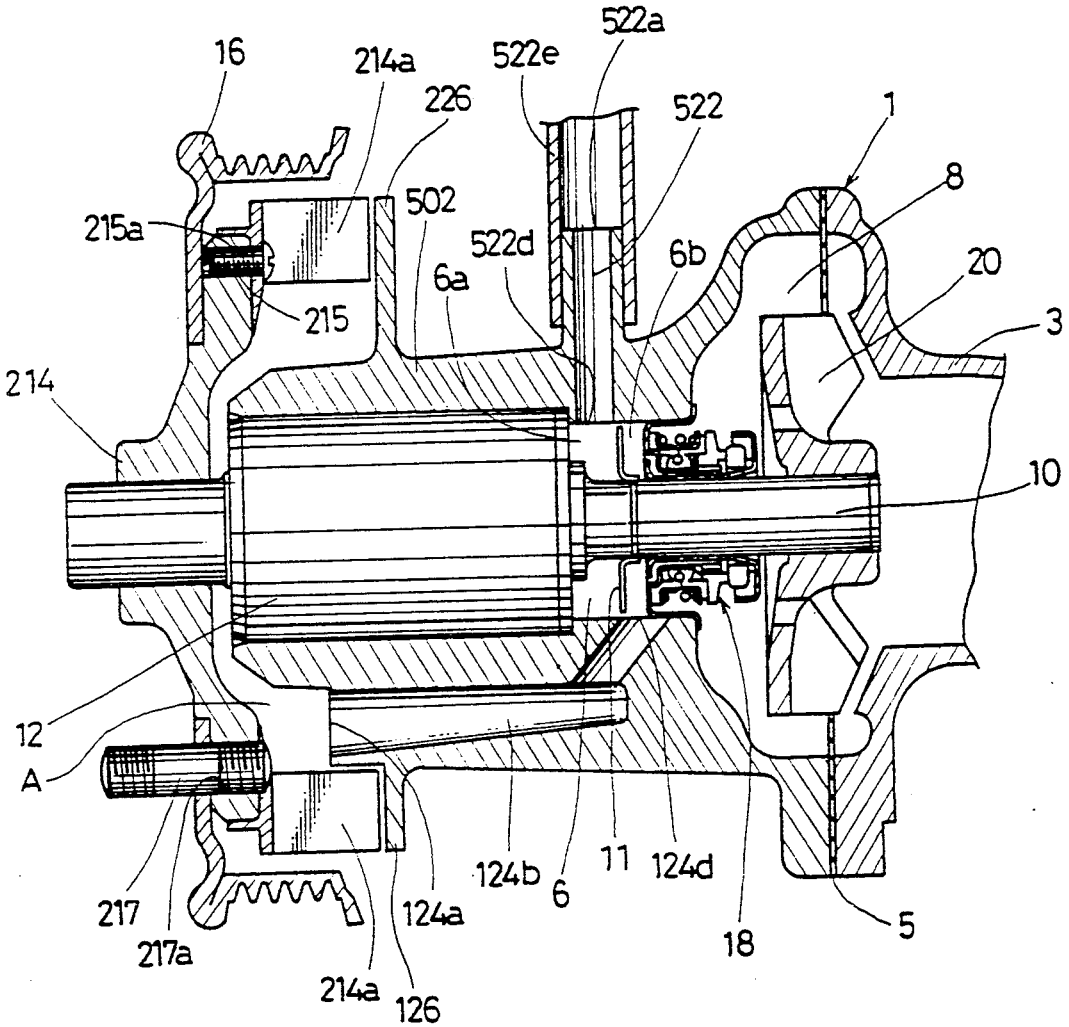
FIG. 24 is a view similar to FIG. 1, showing a fifth preferred embodiment of the present invention.
Figure 26:
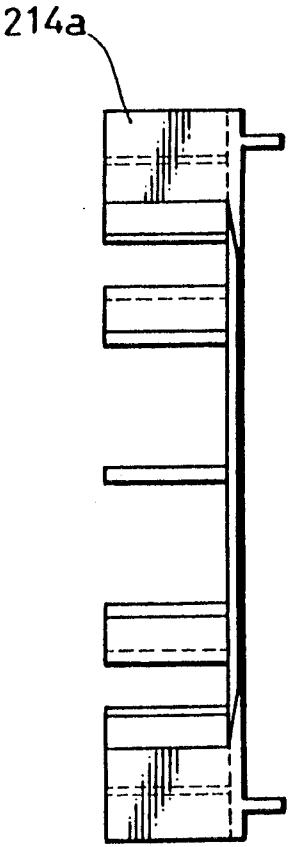
FIG. 26 is a side view of the partition disk taken along the line XXVI—XXVI in FIG. 25.
Figure 25:
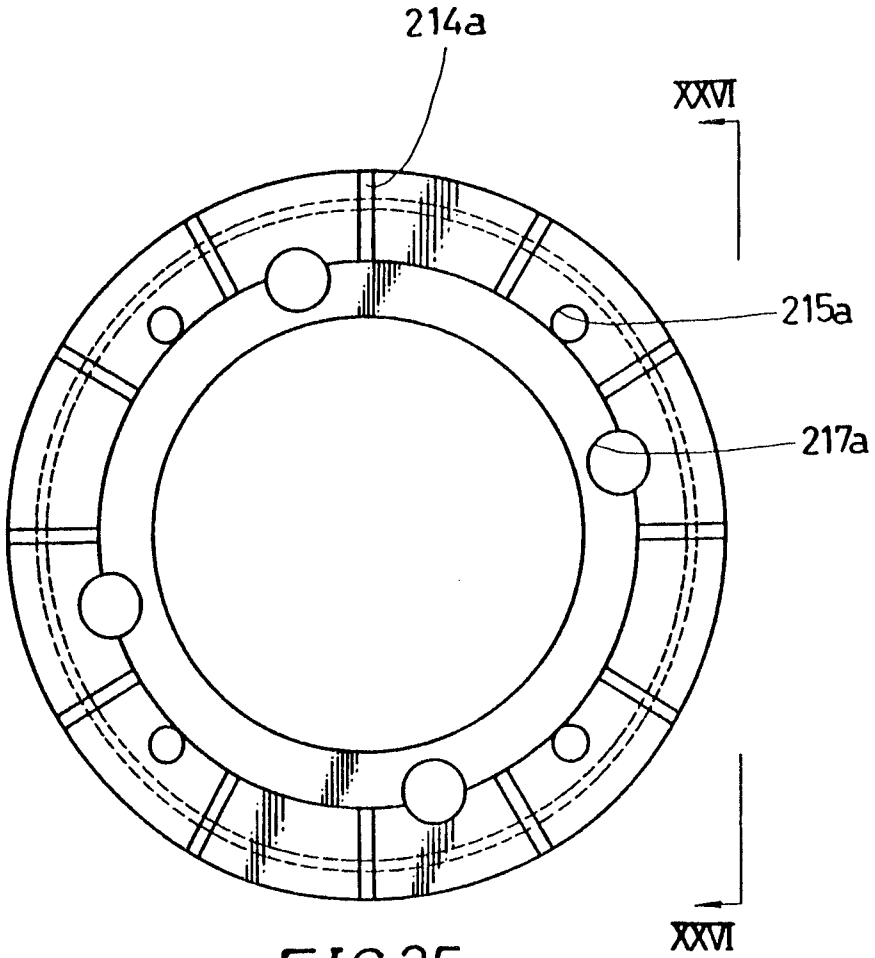
FIG. 25 is an elevational view of a partition disk shown in FIG. 24.

Referring to FIGS. 24 to 26 which show a fifth preferred embodiment of the present invention, a fin member 214*a* having a plurality of fins larger than those shown in FIG. 22 is fixed by bolts 215 to a pulley seat 214. A suction passage 522 in this preferred embodiment extends upwardly vertically from the intermediate chamber 6, and an outer opening 522*a* of the suction passage 522 is connected through a hose 522*e* to an air cleaner (not shown), so that the outside air to be sucked into the intermediate chamber 6 is filtrated by the air cleaner to thereby prevent entry of dust or the like into the intermediate chamber 6. Alternatively, the outer opening 522*a* of the suction passage 522 may be directly exposed to an inside of an engine cover (not shown) without using the hose 522*e*.

In this preferred embodiment, a partition disk 226 for defining a vacuum generating space A is integrally formed with a pump body 502 in such a manner as to project radially outwardly from the outer periphery of the pump body 502 and face the fin member 214*a*. A ventilation characteristic of this preferred embodiment is shown by a line C2 in FIG. 29.

Figure 27:
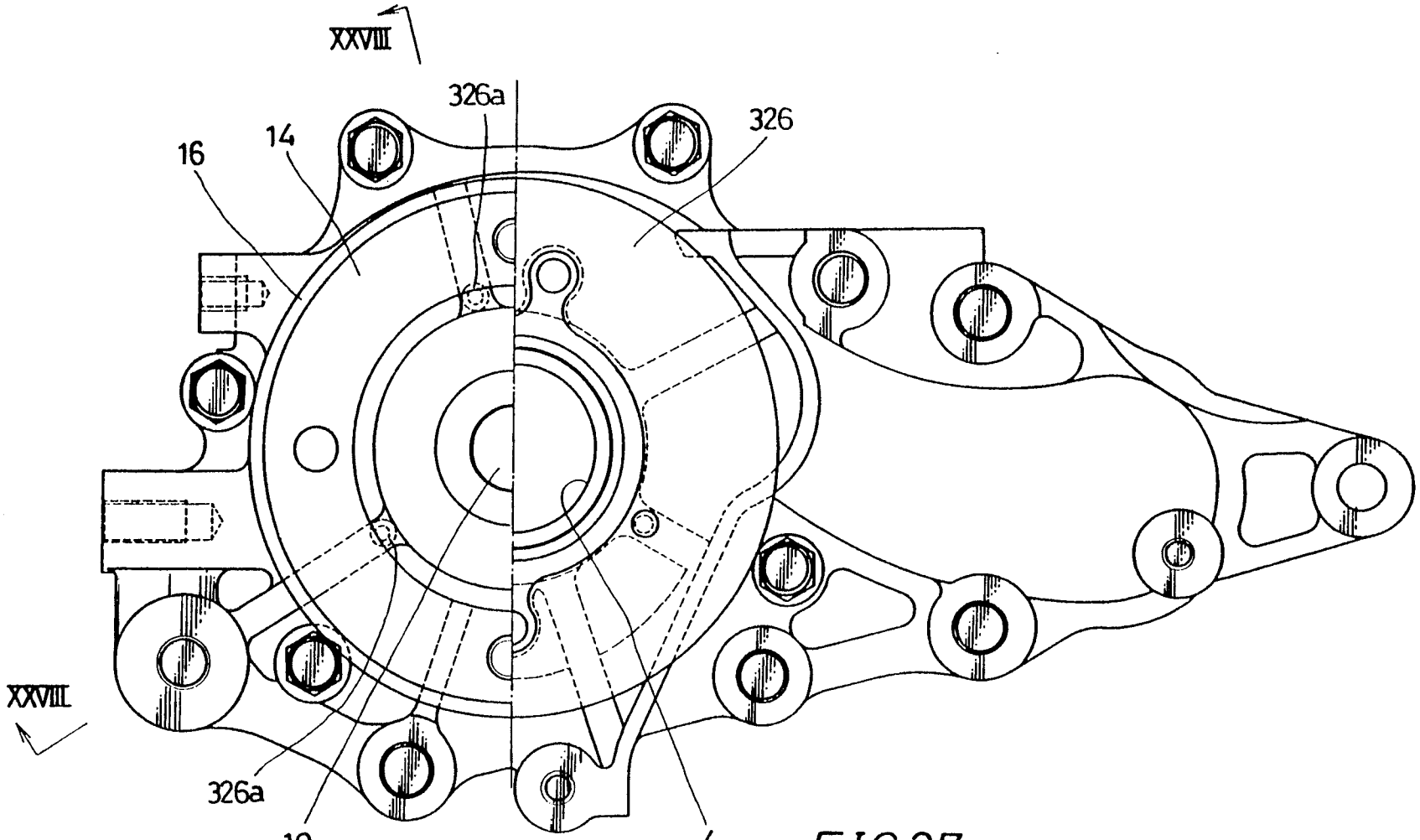
FIG. 27 is a front end view of the water pump showing a mounting structure of the partition disk.
Figure 28:
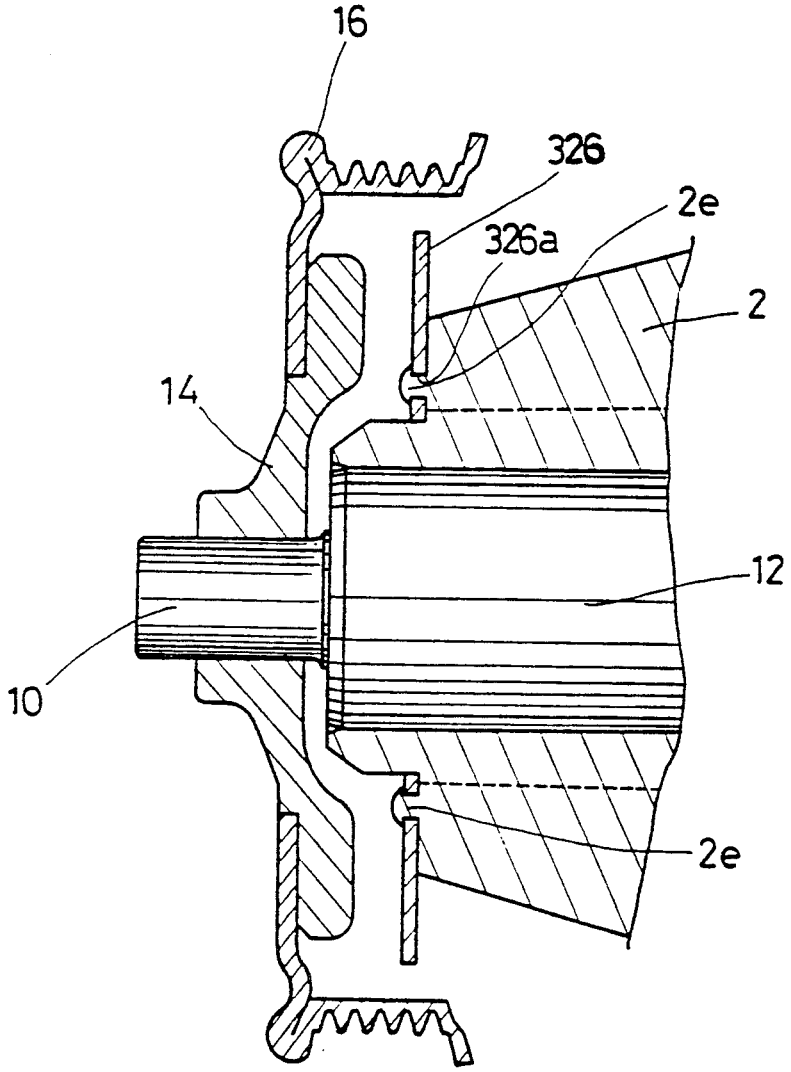
FIG. 28 is a cross section taken along the line XXVIII—XXVIII in FIG. 27.

Referring to FIGS. 27 and 28 which show a modification of the mounting structure of the partition disks 26 and 126 shown in FIGS. 20, 21 and 22, a partition disk 326 is formed with a plurality of through-holes 326*a*, and a front end surface of the pump body 2 is formed with a plurality of projections 2*e* to be engaged with the through-holes 326*a* of the partition disk 326. After engagement of the projections 2*e* with the through-holes 326*a*, a head of each projection 2*e* is rivetted to thereby fix the partition disk 326 to the pump body 2. Alternatively, a plurality of pins may be press-fitted with the through-holes 326*a* of the partition disk 326 and holes formed on the front surface of the pump body 2.

Having thus described the preferred embodiments of the invention, it should be understood that numerous structural modifications and adaptations may be made without departing from the spirit of the invention.

What is claimed is:

1. In a water pump including:

a pump housing having a central axial through-hole;

a pump shaft inserted in said through-hole;

a pulley fixed on said pump shaft at one end thereof;

an impeller fixed on said pump shaft at the other end thereof;

a bearing fitted with said through-hole for rotatably supporting said pump shaft in the vicinity of said pulley;

a water seal provided between said impeller and said bearing for sealing water in a pump chamber where said impeller is installed, wherein an intermediate chamber is defined by said pump housing, said bearing and said water seal;

the improvement comprising:

a first ventilation passage formed in an upper half of a wall of said pump housing so as to permit entry of an atmospheric air into said intermediate chamber;

a second ventilation passage formed in a lower half of said wall of said pump housing so as to discharge a water vapor in said intermediate chamber to an outside of said pump housing; and a vacuum generating portion to be formed by rotation of said pulley in the vicinity of an outlet of said second ventilation passage opening to a a substantially enclosed space defined by a rear side of said pulley, an end portion of said pump housing opposed to said rear side of said pulley and a portion of said pulley which extend beyond said second ventilation passage opening;

whereby when said pulley is rotated, the water vapor in said intermediate chamber is positively ventilated through said second ventilation passage by a vacuum generated in said vacuum generating portion.

2. The water pump as defined in claim 1, wherein said first ventilation passage extends upwardly vertically from said intermediate chamber, further comprising a cap for air communicatably covering an upper opening of said first ventilation passage so as to prevent entry of a foreign matter from said upper opening of said first ventilation passage into said intermediate chamber, whereby the atmospheric air is induced through said first ventilation passage into said intermediate chamber during rotation of said pulley, while the water vapor in said intermediate chamber is naturally ventilated through said first ventilation passage upon stoppage of said pulley.

3. The water pump as defined in claim 2, wherein said cap is integrally formed of resin having a heat conductivity smaller than that of metal.

4. The water pump as defined in claim 2, wherein said cap is comprised of a barrel portion formed of resin and a head portion formed of metal, said head portion being fixed to an upper end of said barrel portion.

5. The water pump as defined in claim 2, wherein said cap is comprised of a barrel portion formed of resin and a net-like head portion fixed to an upper end of said barrel portion.

6. The water pump as defined in claim 1, wherein said pulley is formed with a plurality of through-holes arranged at circumferentially given intervals.

7. The water pump as defined in claim 1, wherein said pulley is formed with a plurality of thin-walled portions arranged at circumferentially given intervals.

8. The water pump as defined in claim 1, wherein said pulley is formed with a plurality of cut-away portions arranged at circumferentially given intervals.

9. The water pump as defined in claim 1, wherein a portion of said pump housing opposed to said pulley is enlarged in outer diameter.

10. The water pump as defined in claim 1 further comprising an air filter connected to an outer opening of said first ventilation passage.

11. The water pump as defined in claim 1, wherein an outer opening of said first ventilation passage is opposed to said pulley, further comprising a partition disk provided between said outer opening and said pulley.

12. The water pump as defined in claim 11, wherein an outer circumference of said partition disk is disposed close to said pulley.

13. The water pump as defined in claim 11 further comprising fin means projecting toward said partition disk for accelerating the generation of vacuum in said vacuum generating portion.

14. The water pump as defined in claim 13, wherein said fin means comprises a plurality of coupling bolts for connecting a pulley seat mounted on said pump shaft with a pulley disk for winding a pulley belt therearound.

15. The water pump as defined in claim 13, wherein said fin means comprises a plurality of fin portions integrally formed with said pulley.

16. The water pump as defined in claim 13 wherein said fin means comprises a ring-like fin member having a plurality of fins, said fin member being fixed to said pulley.

17. The water pump as defined in claim 11, wherein said partition disk is fixed to said pump housing.

18. The water pump as defined in claim 11, wherein said partition disk is integrally formed with said pump housing.

19. The water pump as defined in claim 1, wherein said first ventilation passage extends substantially vertically upwards from said intermediate chamber, whereby the atmospheric air is induced through said first ventilation passage into said intermediate chamber during rotation of said pulley, while the water vapor in said intermediate chamber is naturally ventilated through said first ventilation passage upon stoppage of said pulley.

20. The water pump as defined in claim 19, wherein said first ventilation passage has a diameter larger than a diameter of at least a segment of said second ventilation passage.

21. The water pump as defined in claim 1, wherein said second ventilation passage is located in said housing below said shaft.

* * * * *